US008151381B2

(12) United States Patent
Pesta

(10) Patent No.: US 8,151,381 B2
(45) Date of Patent: Apr. 10, 2012

(54) CABLE-ATTACHED SAFE POOL COVER EDGE BARRIER

(75) Inventor: LeeAnn Pesta, West Babylon, NY (US)

(73) Assignee: Pool Cover Corporation, Hauppauge, NY (US)

( * ) Notice: Subject to any disclaimer, the term of this patent is extended or adjusted under 35 U.S.C. 154(b) by 1041 days.

(21) Appl. No.: 12/080,774

(22) Filed: Apr. 4, 2008

(65) Prior Publication Data

US 2009/0249538 A1 Oct. 8, 2009

(51) Int. Cl.
*E04H 4/00* (2006.01)

(52) U.S. Cl. ..... 4/503; 4/498; 4/496; 4/504

(58) Field of Classification Search ..... 4/503, 498, 4/502, 504; 126/565, 563; 52/288.1
See application file for complete search history.

(56) References Cited

U.S. PATENT DOCUMENTS 2,952,024 A * 9/1960 Bartolucci ..... 4/503
3,555,573 A * 1/1971 Turner ..... 264/35
3,886,020 A * 5/1975 Shank, Jr. ..... 156/211
4,635,581 A * 1/1987 Scheurer ..... 114/346
5,608,926 A * 3/1997 Donaton ..... 4/503
RE41,442 E * 7/2010 Morgan et al. ..... 52/23
2004/0143896 A1* 7/2004 Last ..... 4/502

* cited by examiner

*Primary Examiner* — Gregory Huson
*Assistant Examiner* — Lauren Heitzer
(74) *Attorney, Agent, or Firm* — Alfred M. Walker

(57) ABSTRACT

A flexible safety barrier edge material contacts a wall of a poolside raised obstacle with a hollow loop crossection. The loop portion is slit at multiple intervals to permit the individual sections to conform to relatively sharp inside or outside corner contours of the obstruction. A continuous stainless steel cable is guided around the respective portion of the pool cover periphery in the vicinity of the obstruction, by passing it through fabric webbing loops sewn at the edge of the pool cover. This cable is attached to a top surface of the pool wall deck using pool anchors with split loops having a cable receiving slot. The cable is looped thru said turnbuckle and secured via cable clamps and then tightened by the use of turnbuckles at either end of the cable.

11 Claims, 3 Drawing Sheets

Fig. 2
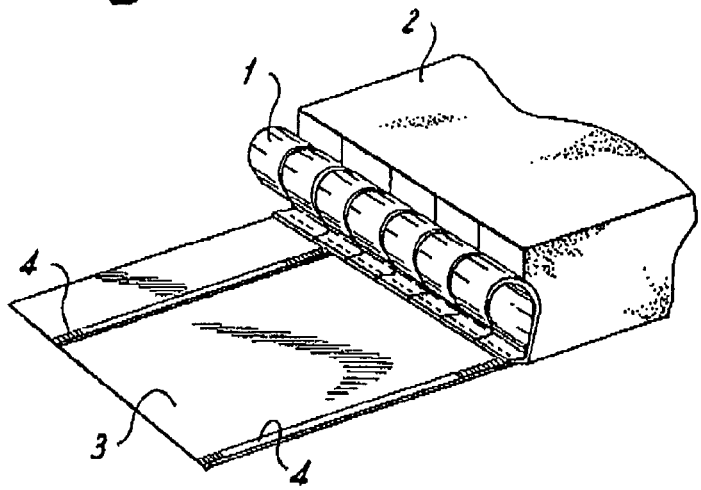
Fig. 3
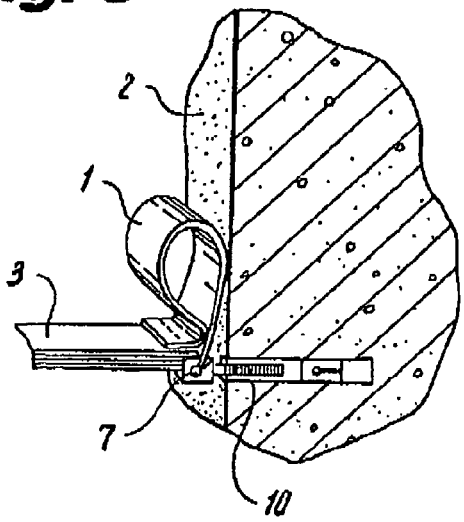
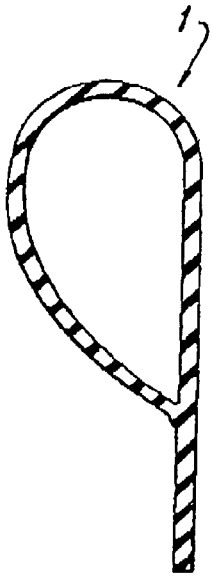
Fig. 4

CABLE-ATTACHED SAFE POOL COVER EDGE BARRIER

FIELD OF THE INVENTION

The present invention relates to safety edge features for swimming pool covers which cover a swimming pool with poolside raised obstacles, such as rock walls or other three dimensional obstructions.

BACKGROUND OF THE INVENTION

Conventional pool covers are installed by periodic attachment to the horizontal deck above the vertical pool wall, using anchors attached to spring tension members. Poolside raised obstacles preclude this type of fastening in the vicinity of the obstacle.

Attachment to the obstacle wall itself or alternate attachment of the entire pool cover to concrete vertical pool walls is an option described in the prior art. Due to the periodic nature of the attachment this often leaves gaps of varying sizes between the edge of the pool cover and the pool obstruction wall so as to present a hazard. To prevent falling of persons or objects between the pool cover and pool wall, U.S. Pat. No. 4,982,457 of Donaton describes a flexible sloping continuous edge attached to the pool cover that closes the gap between the cover and the wall. In a further patent by Donaton (U.S. Pat. No. 5,608,926), a Loop-Loc fastener is described to facilitate secure attachment to the edge of the pool cover while attaching the edge to the pool wall in a close horizontal relationship to enhance the performance of the safety edging of the previous patent.

Over the years, pool contours and those of raised poolside obstacles have become more varied. A pool cover edging more conformable to these obstacle wall shapes is desired. An easier method of installation of the pool cover with the added ability to tighten the attachment between a cover and pool obstruction wall is also desired.

OBJECTS OF THE INVENTION

The objects of the present invention are to provide a system whereby a pool cover includes a safety barrier edge, which is conformable to complex poolside raised obstacle wall contours, installs with less labor, and can be tightened after installation.

Other objects which become apparent from the following description of the present invention.

SUMMARY OF THE INVENTION

In keeping with these objects and others which may be apparent, the present invention is a system known in the trade as Cable-Loc™, whereby a pool cover includes a safety barrier edge is conformable to portions of the swimming pool having complex pool wall obstruction contours, such as rock walls or other upright poolside obstacles, and wherein the safety barrier can be installed with less labor, and can be tightened after installation.

The safety barrier edge material that contacts the complex swimming pool obstruction wall is flexible with a hollow loop crossection; preferably the material is extruded of low linear density polyethylene (LLDPE) or similar plastic material. The loop portion is preferably slit every 2.5 inches to permit the individual sections to conform to relatively sharp inside or outside corner contours. A continuous stainless steel cable (preferably aircraft quality and pre-stretched) is guided around the portion of the pool cover periphery in the vicinity of the complex swimming pool contour obstruction, by passing it through fabric webbing loops sewn at the edge of the respective portion of the swimming pool cover. Alternatively, the cable is passed through metal D-rings which are retained by the webbing loops. This cable is attached to the poolside raised obstacle, using wall anchors with split loops having a cable receiving slot. The cable is slid into the anchor loops and then tightened by the use of a turnbuckle at either end of the cable. The Cable-Loc™ system attaches the pool cover to the raised poolside obstacle wall at the level of the decking around pool well above the water level; this maintains a uniform horizontal installation.

BRIEF DESCRIPTION OF THE DRAWINGS

The present invention can best be understood in connection with the accompanying drawings. It is noted that the invention is not limited to the precise embodiments shown in drawings, in which:

FIG. 2 is a perspective detail showing the safety barrier attached to a pool cover and conforming to the inner pool obstruction wall.

FIG. 3 is a perspective detail showing the use of the Cable-Loc™ wall anchor system for attaching the pool cover to the inner pool obstruction wall.

FIG. 4 is a side crossection of the safety barrier edge material.

DETAILED DESCRIPTION OF THE INVENTION

Figure 1:
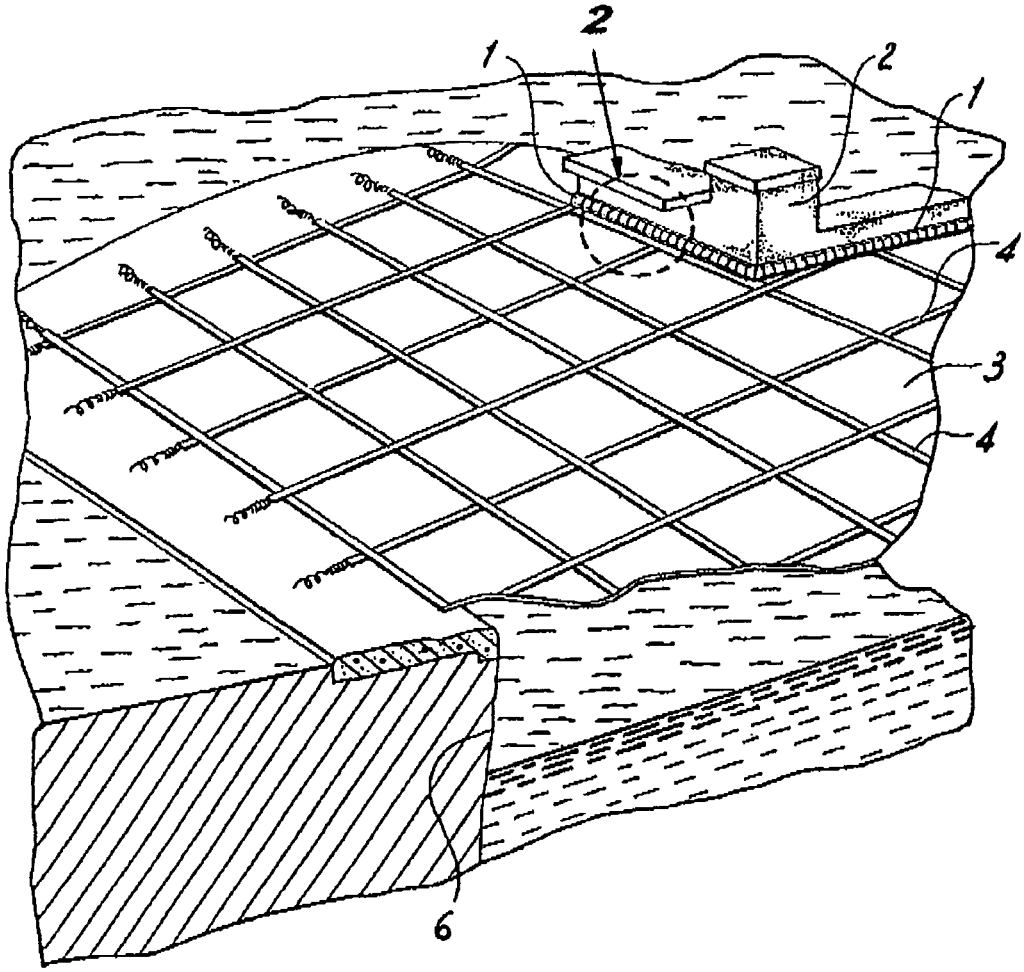
FIG. 1 is a perspective view of a pool using a Cable-Loc™ pool cover of this invention with a slit safety barrier edge in the vicinity of a complex upright obstruction of the swimming pool, such as, for example, a rock wall.

FIG. 1 shows a portion of a pool with a Cable-Loc™ pool cover installed in the vicinity of contoured upright pool obstruction region wall 2. The barrier edge 1 can be seen against contoured pool obstruction wall 2 at the juncture between pool cover 3 and contoured pool obstruction wall 2. Pool cover material 3 is reinforced with webbing 4. It is noted that the pool cover anchors with spring tension members 5 attaching pool cover 3 to pool decking in regions away from any raised poolside obstacle. Pool wall 6 is not used for cover 3 attachment.

The detail of FIG. 2 shows how barrier edge 1 folds up approximately 90 degrees against raised poolside obstacle wall 2; the optional but preferable periodic slits in the loop area of barrier 1 are also clearly visible.

FIG. 3 shows a further detail with raised poolside obstacle wall 2 in crossection, revealing a portion of Cable-Loc™ wall anchor system 10. Cable 7 is also shown in an end view. The vertical location of anchor 10 is above water level and maintains the uniform horizontal appearance of the rest of pool cover 3.

FIG. 4 shows a crossection of barrier edge extrusion 1 with nominal dimensions, preferably of a minimum of 4.0 inches overall length with attachment section having segmented intervals of about 1 inch and loop section of about 2.5 inches. The hollow loop is shown to be of about 3/32 inch thickness while the attachment section is shown to be 1/8 inch thick.

Figure 5:
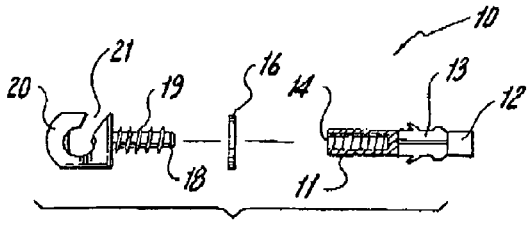
FIG. 5 is a side exploded view of the Cable-Loc™ wall anchor system showing the expansion sleeve, the fender washer, and the cable wall anchor with split cable loop.

FIG. 5 shows an exploded view of the three main sections of the Cable-Loc™ wall anchor system comprising an anchor fastener, such as, for example, expansion sleeve 11, fender washer 16, and cable wall anchor 18. Expansion sleeve 11 is designed to be inserted into a hole, such as, for example, a 3/8 inch diameter hole in contoured pool obstruction wall 2. It preferably includes split expansion collar 13 which is expanded by expansion cone 12 when female threads 14 are engaged with male threads 19 on wall anchor 18. It is noted that the nibs protruding from the periphery of expansion collar 13 will be embedded in the walls of the installation hole after installation.

Figure 6:
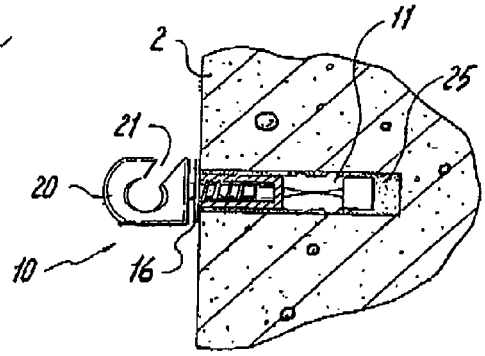
FIG. 6 is a side view in partial crossection of an installed Cable-Loc™ wall anchor in an inner pool obstruction wall of a swimming pool.

After installation in hole 25 of poolside obstacle poolside obstacle wall 2, as shown in FIG. 6, wall anchor 18 will accept cable 7 in loop 20 via up-facing cable receiving slot 21. This is easily performed from the top side of pool cover 3.

Figure 7:
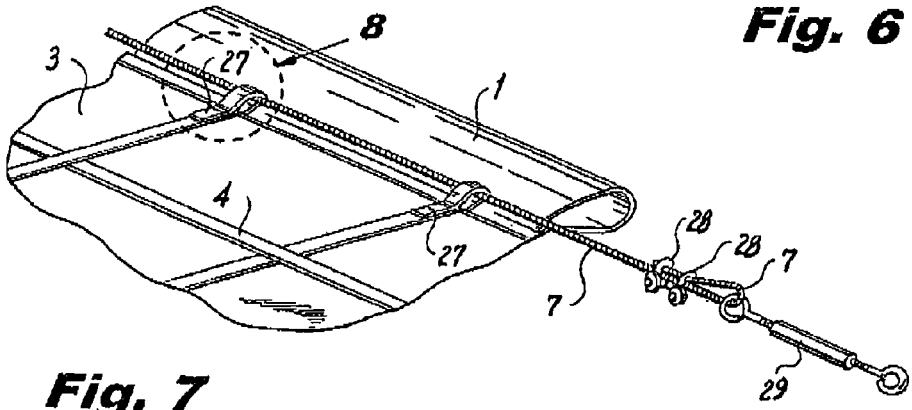
FIG. 7 is a perspective bottom side detail of the Cable-Loc™ pool cover showing the cable retained in fabric loops.

FIG. 7 is a bottom-side view of the edge of pool cover 3 showing fabric webbing straps forming loops 27 which capture cable 7. Loops 27 are formed at distal ends of fabric webbing members 4 extending perpendicular to the edge of pool cover 3 having barrier edge 1 extending therefrom. Although loops 27 are shown sewn to webbing 4 in FIG. 7, alternatively snaps can be used as releasable fasteners to facilitate more convenient cable installation. One of the two ends of cable 7 is shown looped through an eye in a tension applicator, such as, for example, turnbuckle 29 and secured with fasteners, such as two U-bolts 28. Turnbuckle 29 is used to tighten cable 7 after installation in all of the cable wall anchor loops 20.

Figure 8:
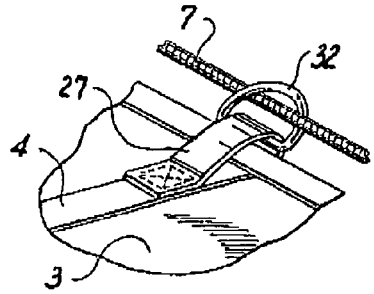
FIG. 8 is a perspective detail showing the use of D-rings to retain the cable.

The alternate embodiment of FIG. 8 is an enlarged detail showing the use of D-ring 32 retained by webbing loop 27; cable 7 is then threaded through D-rings 32.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

I claim:

1. A swimming pool safety barrier comprising:

a cover for a swimming pool;

said cover having an integral and looped barrier edge which is flexible and conformable to a contoured poolside raised obstruction wall;

said barrier edge in contact with said wall of said contoured poolside raised obstruction;

spaced anchor assemblies mounted in said contoured poolside raised obstruction wall adjacent to said barrier edge of said cover;

each of said anchor assemblies having a loop member with an up-facing cable receiving slot in an anchor member extending from said contoured poolside raised obstruction wall for receiving a cable;

said barrier edge having slots to conform to said obstruction wall; and means underneath and attached to said cover adjacent said barrier edge of said cover for engaging said cable whereby said cable passes through each said loop member and holds said barrier edge in contact with said contoured poolside raised obstruction wall.

2. The safety barrier of claim 1 having means to apply tension to said cable.

3. The safety bather of claim 2 in which said tension means is a turnbuckle.

4. The safety barrier of claim 1 in which said up-facing cable receiving slot is tilted toward said barrier wall.

5. The safety barrier of claim 4 in which said engaging means comprises straps forming loops for holding said cable.

6. The safety barrier of claim 5 in which said straps have loops for releasably holding said cable in place.

7. The safety barrier of claim 6 in which said loops of said straps each further includes a D-ring extending through each said loop of each said strap, wherein further said cable is threaded through each said D-ring for retention by said loops of said straps.

8. The safety barrier of claim 1 in which said barrier edge comprises an extrusion forming a hollow loop.

9. The safety barrier of claim 8 in which said extrusion is folded upwardly by said contact with said wall.

10. The safety bather of claim 1 in which each said anchor comprises an expansion sleeve embedded into said contoured poolside raised obstruction wall, said expansion sleeve having a threaded member, and said anchor member having a complimentary threaded extension for engaging said threaded member.

11. The safety barrier of claim 10 in which said expansion sleeve is embedded completely within said contoured poolside raised obstruction wall with said anchor member extending beyond said wall to engage said cable.

* * * * *